US011722823B2

(12) United States Patent
Yang

(10) Patent No.: US 11,722,823 B2
(45) Date of Patent: Aug. 8, 2023

(54) SPEAKER

(71) Applicant: AAC Microtech (Changzhou) Co., Ltd., Changzhou (CN)

(72) Inventor: Huhu Yang, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 97 days.

(21) Appl. No.: 17/560,266

(22) Filed: Dec. 23, 2021

(65) Prior Publication Data

US 2023/0090003 A1 Mar. 23, 2023

(30) Foreign Application Priority Data

Sep. 22, 2021 (CN) ..... 202122295061.3

(51) Int. Cl.

| | |
|---|---|
| ***H04R 9/06*** | (2006.01) |
| ***H04R 1/02*** | (2006.01) |
| ***H04R 9/04*** | (2006.01) |
| ***H04R 9/02*** | (2006.01) |
| ***H04R 31/00*** | (2006.01) |

(52) U.S. Cl.

CPC ..... *H04R 9/06* (2013.01); *H04R 1/026* (2013.01); *H04R 9/025* (2013.01); *H04R 9/046* (2013.01); *H04R 31/003* (2013.01)

(58) Field of Classification Search

CPC ... H04R 9/06; H04R 1/02; H04R 9/04; H04R 9/02; H04R 31/00; H04R 1/026; H04R 9/025; H04R 9/046; H04R 31/003; H04R 7/14; H04R 9/045; H04R 1/00; H04R 9/043; H04R 7/122; H04R 2209/027; H04R 2499/11; H04R 7/18

USPC ..... 381/333, 386, 388, 396, 398, 400–412

See application file for complete search history.

(56) References Cited

U.S. PATENT DOCUMENTS

| | | | | |
|---|---|---|---|---|
| 8,855,355 | B2 * | 10/2014 | Jiang | H04R 9/06 381/396 |
| 9,025,808 | B2 * | 5/2015 | Kwon | H04R 9/043 381/404 |
| 2012/0128195 | A1 * | 5/2012 | Liu | H04R 7/18 381/386 |
| 2021/0274289 | A1 * | 9/2021 | Wang | H04R 1/2834 |

* cited by examiner

*Primary Examiner* — Carolyn R Edwards
*Assistant Examiner* — Julie X Dang
(74) *Attorney, Agent, or Firm* — W&G Law Group

(57) ABSTRACT

Provided is a speaker, including a frame; a vibration unit fixed to the frame; and a magnetic circuit unit provided with a magnetic gap. The magnetic circuit unit includes a yoke and a magnet; the vibration unit includes a diaphragm and a voice coil; the diaphragm includes a dome and a suspension; the suspension includes an inner edge, an outer edge, a suspension portion, and an extension portion; the diaphragm includes a structural layer and a metal layer; the inner edge includes a first recess, and the extension portion includes a second recess; and the voice coil is electrically connected to the metal layer through the first recess, and the metal layer is electrically connected to an external circuit through the second recess. With this structure, an internal space of the speaker is saved, reducing material cost and improving reliability.

9 Claims, 4 Drawing Sheets

A–A

SPEAKER

TECHNICAL FIELD

The present disclosure relates to the technical field of electronic elements, in particular to a speaker.

BACKGROUND

A speaker typically includes a magnetic circuit unit composed of a yoke, a magnet and a pole plate, and a vibration unit composed of a diaphragm, a voice coil and a holder. In order to improve the stability of the vibration unit, a lower diaphragm is usually fixed to a lower end of the voice coil to support the voice coil. Besides, a flexible printed circuit (FPC) is typically provided between the lower end of the voice coil and the lower diaphragm to electrically connect the voice coil to an external circuit. An inner side of the FPC is electrically connected to the voice coil, an outer side of the FPC is electrically connected to the external circuit, and an elastic arm between the inner side and the outer side of the FPC provides an elastic force for elastic vibration.

However, the FPC requires a large internal space of the speaker. A short arm length of the FPC will cause low reliability and fracture of the FPC, and an insufficient internal space of the speaker will result in an interference between the FPC and the lower diaphragm.

To solve the above problem, it needs to provide a speaker with a conductive diaphragm.

SUMMARY

An objective of the present disclosure is to provide a speaker with a conductive diaphragm.

An embodiment of the present disclosure provides a speaker, including: a frame; a vibration unit fixed to the frame; and a magnetic circuit unit provided with a magnetic gap. The magnetic circuit unit includes a yoke fixed to the frame and a magnet fixed to a side of the yoke close to the vibration unit; the vibration unit includes a diaphragm fixed to the frame and a voice coil fixed to the diaphragm; the voice coil is inserted in the magnetic gap to drive the diaphragm to vibrate and produce sound; the diaphragm includes a dome located at a central position and a suspension surrounding the dome; the suspension includes an inner edge fixed to and connected to the dome, an outer edge fixed to and connected to the frame, a suspension portion connecting the inner edge and the outer edge, and at least one extension portion extending from the outer edge in a direction away from the dome; the diaphragm includes a structural layer and a metal layer buried in the structural layer; the inner edge includes at least one first recess provided in the structural layer to expose the metal layer, and the at least one extension portion includes at least one second recess provided in the structural layer to expose the metal layer; and the voice coil is electrically connected to the metal layer through the at least one first recess, and the metal layer is electrically connected to an external circuit through the at least one second recess.

As an improvement, the structural layer includes a first structural layer located at a side of the metal layer close to the voice coil and a second structural layer located at a side of the metal layer away from the voice coil; and the at least one first recess and the at least one second recess penetrate through the first structural layer.

As an improvement, the voice coil has a racetrack shape; the at least one first recess includes two first recesses; and the two first recesses are located at two corners of the voice coil along a short edge of the voice coil.

As an improvement, the voice coil is fixed to the inner edge, and the two first recesses are provided between the voice coil and the suspension portion.

As an improvement, a projection of the at least one second recess along a vibrating direction does not overlap with the frame.

As an improvement, the at least one extension portion includes two extension portions, and the two extension portions correspond to the at least one first recess.

As an improvement, the speaker further includes lower diaphragms fixed to an end of the voice coil away from the diaphragm, the magnet includes a main magnet located at a central position and auxiliary magnets that are spaced apart from each other at a peripheral side of the main magnet and spaced apart from the main magnet to form the magnetic gap; the auxiliary magnets include first auxiliary magnets arranged along long edges of the voice coil and second auxiliary magnets arranged along short edges of the voice coil; the first auxiliary magnets are spaced apart from the second auxiliary magnets to form accommodating gaps; and the lower diaphragms are accommodated in the accommodating gaps.

As an improvement, the magnet includes a main magnet located at a central position and auxiliary magnets that are spaced apart from each other at a peripheral side of the main magnet and spaced apart from the main magnet to form the magnetic gap, and the magnetic circuit unit further includes a main pole plate fixed to a surface of the main magnet facing the diaphragm and auxiliary pole plates fixed to surfaces of the auxiliary magnets facing the diaphragm.

As an improvement, the dome is fixed to a surface of the inner edge away from the voice coil.

Compared with the prior art, the diaphragm of the speaker provided by the embodiments of the present disclosure includes a dome and a suspension. The suspension includes, along a direction from inside to outside, an inner edge, a suspension portion, an outer edge, and extension portions that extend from the outer edge in a direction away from the dome. The diaphragm further includes a structural layer and a metal layer buried in the structural layer. The inner edge includes first recesses provided in the structural layer to expose the metal layer, and the extension portions each include a second recess provided in the structural layer to expose the metal layer. The voice coil is electrically connected to the metal layer through the first recesses, and the metal layer is electrically connected to the external circuit through the second recess. Therefore, the electric connection between the voice coil and the external circuit is realized through the metal layer in the diaphragm. This structure ensures the electrical connectivity between the voice coil and the external circuit, and eliminates the need for a flexible printed circuit (FPC), saving the internal space of the speaker and reducing the material cost. In this way, a risk of FPC fracture, which would affect the reliability of the speaker, can be avoided; besides, a risk of interference between the conductive lower diaphragms and the FPC can be avoided, thereby achieving a more reliable and stable acoustic performance of the speaker.

DETAILED DESCRIPTION OF EMBODIMENTS

In order to make the objectives, technical solutions and the advantages of the present disclosure clearer, the present disclosure is described in further detail below with reference to the drawings and embodiments. Understandably, the described embodiments are merely intended to explain the present disclosure, rather than to limit the present disclosure. All other embodiments obtained by those of ordinary skill in the art based on the embodiments in the present disclosure without creative efforts should fall within the protection scope of the present disclosure.

Terms such as "first", "second", "third" and "fourth" (if any) in the specification, claims and drawings of the present disclosure are intended to distinguish between similar objects, rather than to necessarily indicate a specific order or sequence. It should be understood that these terms such as "first", "second", "third" and "fourth" may be exchanged under proper conditions to make it possible for the described embodiments of the present disclosure to be implemented in a sequence except those illustrated herein. Moreover, the terms "include", "comprise" and their variants mean to cover a non-exclusive inclusion. For example, a process, method, system, product or device that includes a list of steps or units is not necessarily limited to those steps or units which are clearly listed. Instead, they may include other steps or units which are not expressly listed or inherent.

It should be noted that the terms such as "first" and "second" are used herein only for the purpose of description and are not intended to indicate or imply relative importance, or implicitly indicate the number of the indicated technical features. Therefore, features defined by "first" and "second" may explicitly or implicitly include at least one of the features. Further, the technical solutions of the various embodiments may be combined with each other on the basis that the combination is implementable by those of ordinary skill in the art. In case a combination of the technical solutions is contradictory or infeasible, such a combination is deemed in existent and not falling within the protection scope of the present disclosure.

Referring to FIG. 1 to FIG. 6, an embodiment of the present disclosure provides a speaker 100. The speaker 100 includes a frame 10, a magnetic circuit unit 20 fixed to the frame 10 and a vibration unit 30 for vibrating and producing sound. The magnetic circuit unit 20 drives the vibration unit 30 to vibrate and produce sound.

Figure 1:
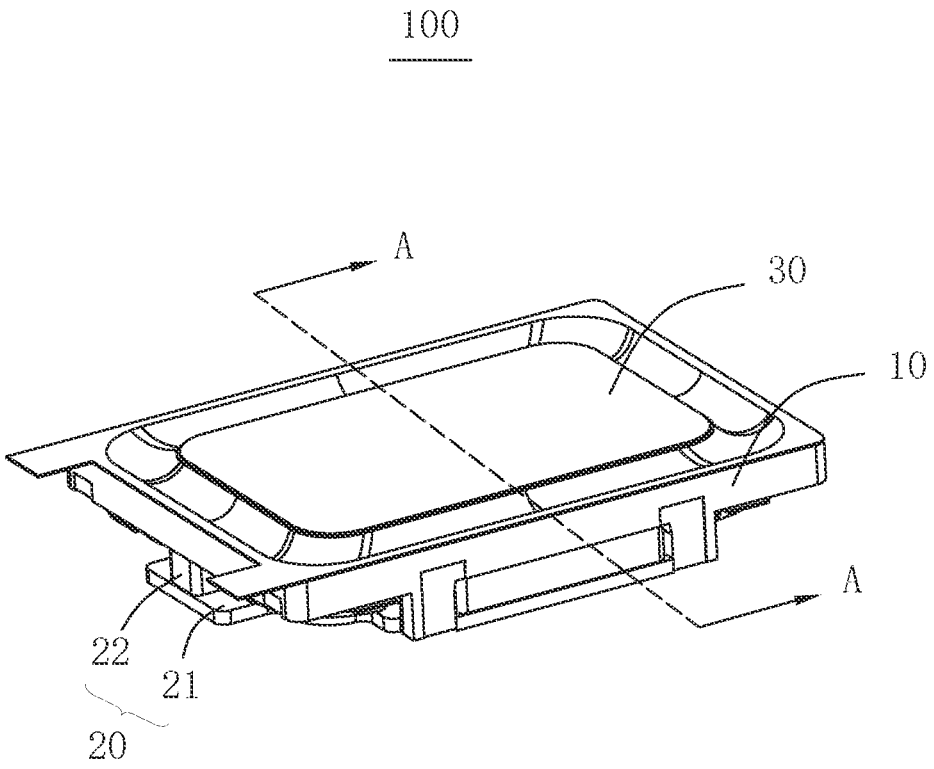
FIG. 1 is a three-dimensional view of a speaker according to an embodiment of the present disclosure.
Figure 2:
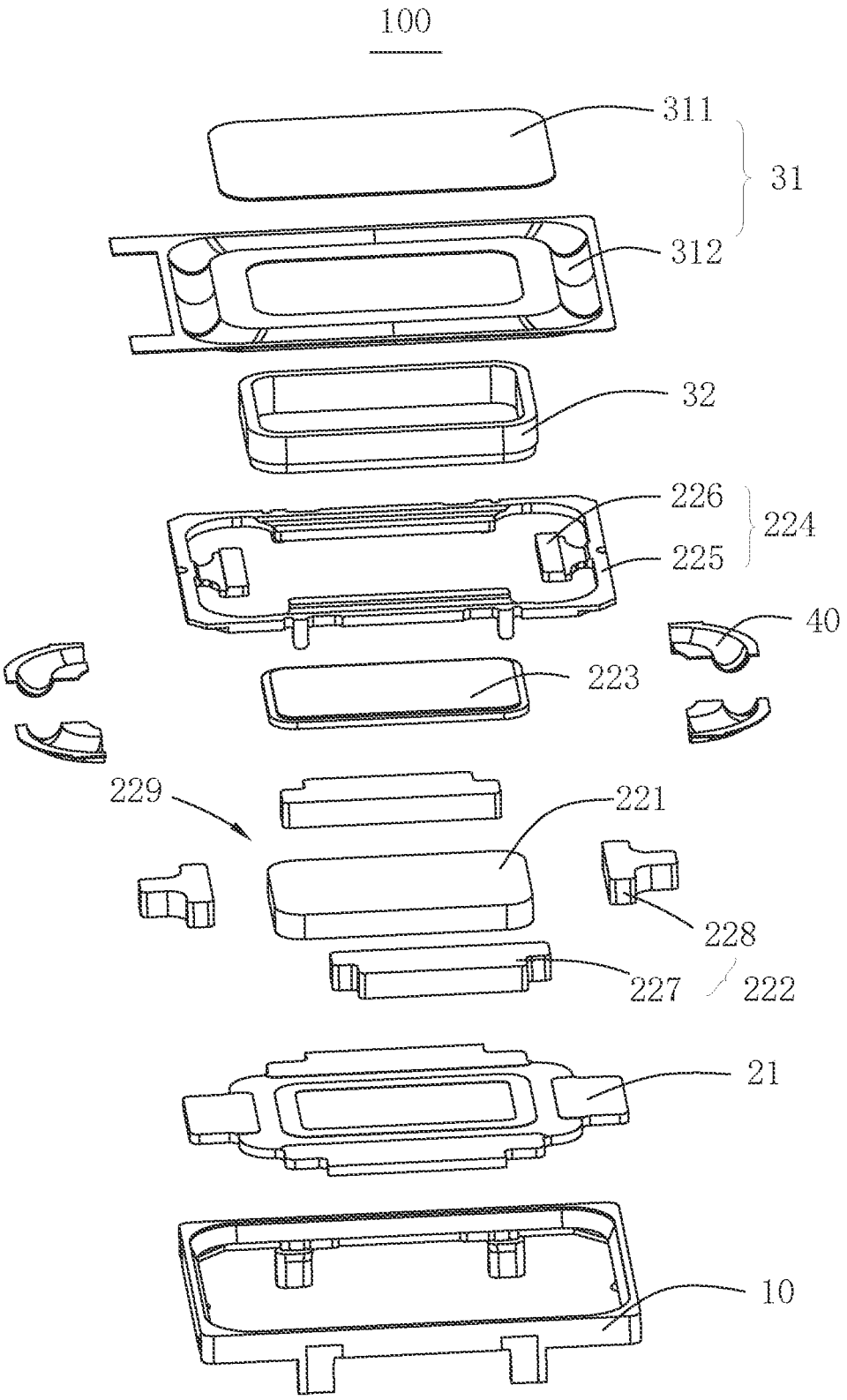
FIG. 2 is an exploded view of a speaker according to an embodiment of the present disclosure.
Figure 3:
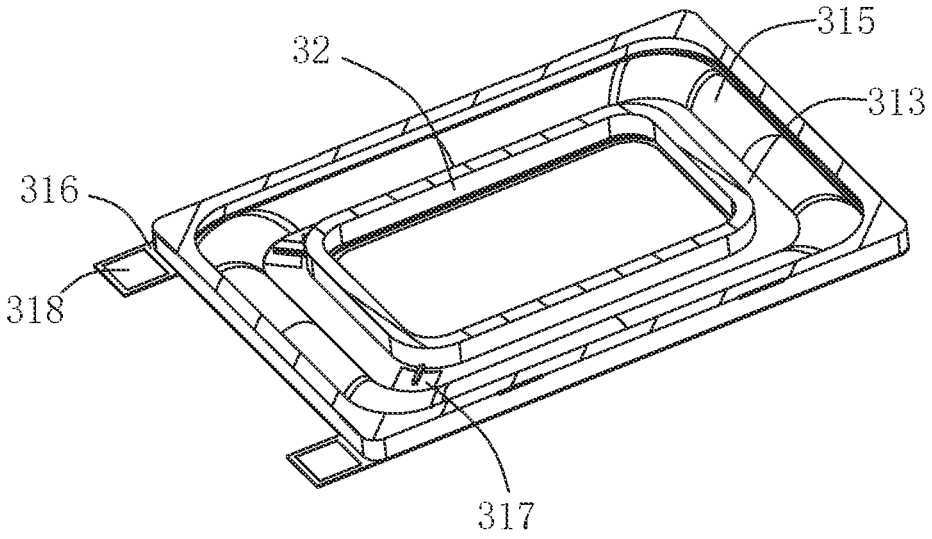
FIG. 3 is a partial view of a speaker according to an embodiment of the present disclosure.
Figure 4:
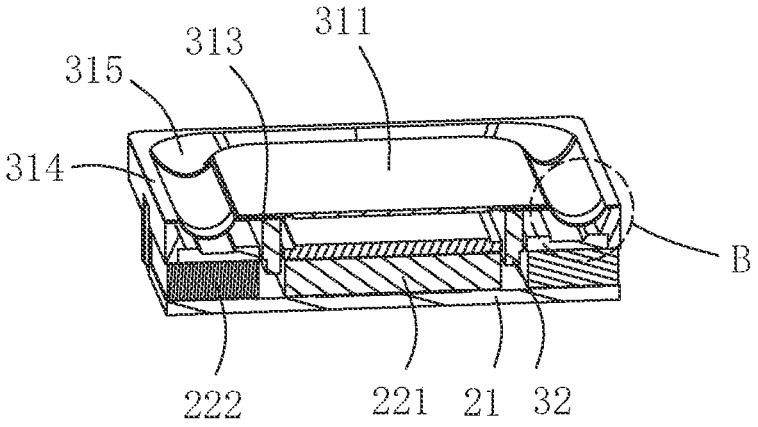
FIG. 4 is a sectional view taken along line A-A shown in FIG. 1.
Figure 5:
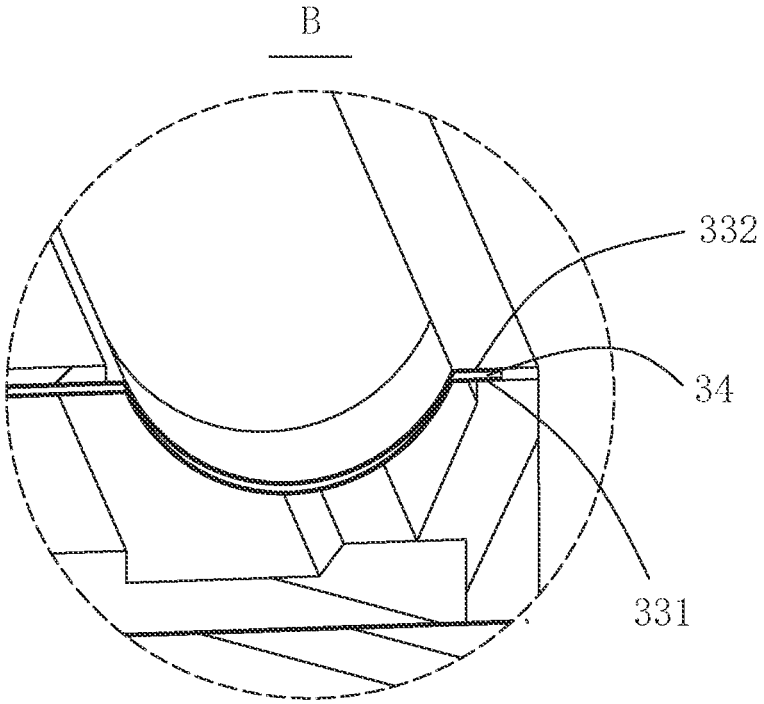
FIG. 5 is an enlarged view of B shown in FIG. 4.
Figure 6:
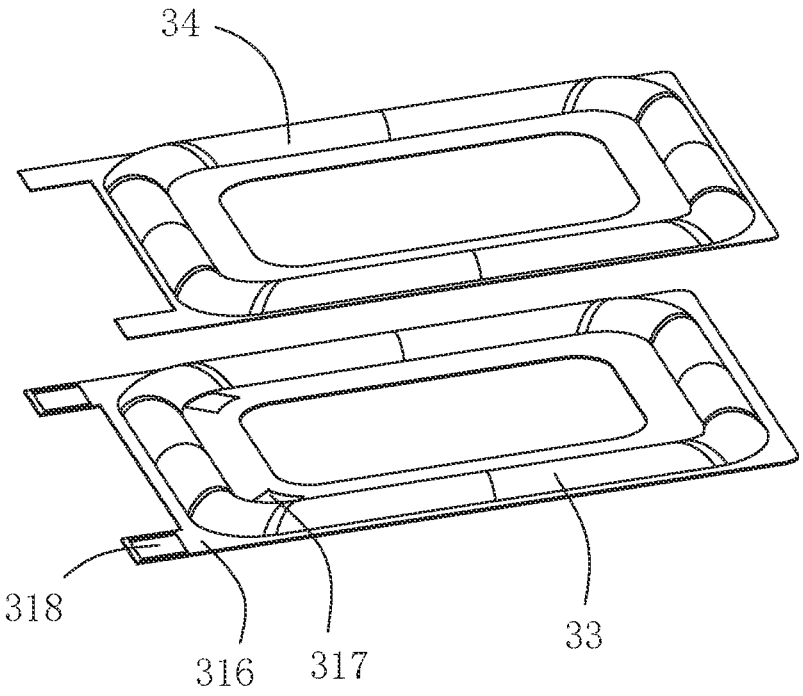
FIG. 6 is a partial view of a speaker according to an embodiment of the present disclosure.

As shown in FIG. 2, the magnetic circuit unit 20 includes a flat yoke 21 fixed to the frame 10 and a magnet 22 fixed to a central position of the yoke 21. In this embodiment, the magnet 22 includes a main magnet 221 located at a central position and auxiliary magnets 222 spaced apart from each other at a peripheral side of the main magnet 221. The main magnet 221 is spaced apart from each of the auxiliary magnets 222 to form a magnetic gap.

As shown in FIG. 2 to FIG. 6, the vibration unit 30 includes a diaphragm 31 fixed to the frame 10 and a voice coil 32 fixed to the diaphragm 31. The voice coil 32 is inserted in the magnetic gap to drive the diaphragm 31 to vibrate and produce sound. In this embodiment, the diaphragm 31 includes a dome 311 located at a central position and a suspension 312 surrounding the dome 311. The suspension 312 includes an inner edge 313 connected to the dome 311, an outer edge 314 fixed to and connected to the frame 10, a suspension portion 315 connecting the inner edge 313 and the outer edge 314, and extension portions 316 extending from the outer edge 314 in a direction away from the dome 311.

In this implementation, as shown in FIG. 2, the magnetic circuit unit 20 further includes a main pole plate 223 fixed to a surface of the main magnet 221 facing the diaphragm 31, and a pole plate 224 fixed to the auxiliary magnets 222. Specifically, the pole plate 224 includes a ring-shaped pole plate body 225 and auxiliary pole plates 226 extending from the pole plate body 225. The auxiliary pole plates 226 are fixed to surfaces of the auxiliary magnets 222 facing the diaphragm 31. The main pole plate 223 and the auxiliary pole plate 226 allow the magnetic induction lines emitted by the main magnet 221 and the auxiliary magnets 222 more concentrated, thereby reducing the magnetic force loss and improving the driving force of the magnetic circuit unit 20. The pole plate body 225 is fixed to the frame 10 so as to integrally fix the magnetic circuit unit 20 to the frame 10 to form a fixed structure. Specifically, four auxiliary magnets 222 are provided. Correspondingly, the pole plate body 225 has a racetrack shape. Four auxiliary pole plates 226 extend from two long edges and two short edges of the pole plate body 225.

As shown in FIG. 3 to FIG. 6, in an embodiment, the diaphragm 31 of the speaker 100 includes a structural layer 33 and a metal layer 34 buried in the structural layer 33. In order to realize the electrical connection between the voice coil 32 and an external circuit, the inner edge 313 includes first recesses 317 provided in the structural layer 33 to expose the metal layer 34, and the extension portions 316 each include a second recess 318 provided in the structural layer 33 to expose the metal layer 34. The voice coil 32 is electrically connected to the metal layer 34 through the first recesses 317, and the metal layer 34 is electrically connected to the external circuit through the second recess 318. In this way, the electric connection between the voice coil 32 and the external circuit is realized without a flexible printed circuit (FPC), thereby saving the internal space of the speaker and reducing the material cost.

Specifically, the structural layer 33 includes a first structural layer 331 located on a side of the metal layer 34 close to the voice coil 32, and a second structural layer 332 located on a side of the metal layer 34 away from the voice coil 32. The first recesses 317 and the second recesses 318 penetrate through the first structural layer 331. In other embodiments, the second recesses 318 may also be provided in the second structural layer 332, as long as the welding of the metal layer 34 with the external circuit is not affected.

Specifically, the voice coil 32 has a racetrack shape. Two first recesses 317 are provided, and the two first recesses 317 are located at two corners of the voice coil 32 along a short edge of the voice coil 32. The voice coil 32 is fixed to the inner edge 313, and the first recesses 317 are provided between the voice coil 32 and the suspension portion 315.

Correspondingly, two extension portions 316 are provided, and the two extension portions 316 correspond to the first recesses 317. That is, the two extension portions 316 are arranged corresponding to corners of the frame 10 along a short edge, and the two extension portions 316 and the first recesses 317 are located at to same side of the voice coil 32. In order to facilitate the welding of the external circuit and the metal layer 34, projections of the second recesses 318 along a vibrating direction does not overlap with the frame 10.

The speaker 100 further includes lower diaphragms 40 fixed to an end of the voice coil 32 away from the diaphragm 31. The auxiliary magnets 222 include first auxiliary magnets 227 arranged along long edges of the voice coil 32 and second auxiliary magnets 228 arranged along short edges of the voice coil 32. The first auxiliary magnets 227 are spaced apart from the second auxiliary magnets 228 to form accommodating gaps 229, and the lower diaphragms 40 are accommodated in the accommodating gaps 229. It is understandable that there are four lower diaphragms 40, which are fixed at four corners of the voice coil 32 respectively.

Compared with the prior art, the diaphragm 31 of the speaker 100 provided by the embodiments of the present disclosure includes a dome 311 and a suspension 312. The suspension 312 includes, along a direction from inside to outside, an inner edge 313, a suspension portion 315, an outer edge 314, and extension portions 316 that extend from the outer edge 314 in a direction away from the dome 311. The diaphragm 31 further includes a structural layer 33 and a metal layer 34 buried in the structural layer 33. The inner edge 313 includes first recesses 317 provided in the structural layer 33 to expose the metal layer 34, and the extension portions 316 each include a second recess 318 provided in the structural layer 33 to expose the metal layer 34. The voice coil 32 is electrically connected to the metal layer 34 through the first recesses 317, and the metal layer 34 is electrically connected to the external circuit through the second recess 318. Therefore, the electric connection between the voice coil and the external circuit is realized through the metal layer in the diaphragm. This structure ensures the electrical connectivity between the voice coil and the external circuit, and eliminates the need for a flexible printed circuit (FPC), saving the internal space of the speaker and reducing the material cost. In this way, a risk of FPC fracture, which would affect the reliability of the speaker, can be avoided; besides, a risk of interference between the conductive lower diaphragms and the FPC can be avoided, thereby achieving a more reliable and stable acoustic performance of the speaker.

The above described are merely implementations of the present disclosure. It should be noted here that those of ordinary skill in the art may make improvements without departing from the concept of the present disclosure, but such improvements should fall within the protection scope of the present disclosure.

What is claimed is:

1. A speaker, comprising:

a frame;

a vibration unit fixed to the frame; and a magnetic circuit unit provided with a magnetic gap, wherein the magnetic circuit unit comprises a yoke fixed to the frame and a magnet fixed to a side of the yoke close to the vibration unit; the vibration unit comprises a diaphragm fixed to the frame and a voice coil fixed to the diaphragm; the voice coil is inserted in the magnetic gap to drive the diaphragm to vibrate and produce sound; the diaphragm comprises a dome located at a central position and a suspension surrounding the dome; the suspension comprises an inner edge fixed to and connected to the dome, an outer edge fixed to and connected to the frame, a suspension portion connecting the inner edge and the outer edge, and at least one extension portion extending from the outer edge in a direction away from the dome; the diaphragm comprises a structural layer and a metal layer buried in the structural layer; the inner edge comprises at least one first recess provided in the structural layer to expose the metal layer, and the at least one extension portion comprises at least one second recess provided in the structural layer to expose the metal layer; and the voice coil is electrically connected to the metal layer through the at least one first recess, and the metal layer is electrically connected to an external circuit through the at least one second recess.

2. The speaker as described in claim 1, wherein the structural layer comprises a first structural layer located at a side of the metal layer close to the voice coil and a second structural layer located at a side of the metal layer away from the voice coil; and the at least one first recess and the at least one second recess penetrate through the first structural layer.

3. The speaker as described in claim 1, wherein the voice coil has a racetrack shape; the at least one first recess comprises two first recesses; and the two first recesses are located at two corners of the voice coil along a short edge of the voice coil.

4. The speaker as described in claim 3, wherein the voice coil is fixed to the inner edge, and the two first recesses are provided between the voice coil and the suspension portion.

5. The speaker as described in claim 1, wherein a projection of the at least one second recess along a vibrating direction does not overlap with the frame.

6. The speaker as described in claim 1, wherein the at least one extension portion comprises two extension portions, and the two extension portions correspond to the at least one first recess.

7. The speaker as described in claim 1, further comprising lower diaphragms fixed to an end of the voice coil away from the diaphragm, wherein the magnet comprises a main magnet located at a central position and auxiliary magnets that are spaced apart from each other at a peripheral side of the main magnet and spaced apart from the main magnet to form the magnetic gap; the auxiliary magnets comprise first auxiliary magnets arranged along long edges of the voice coil and second auxiliary magnets arranged along short edges of the voice coil; the first auxiliary magnets are spaced apart from the second auxiliary magnets to form accommodating gaps; and the lower diaphragms are accommodated in the accommodating gaps.

8. The speaker as described in claim 1, wherein the magnet comprises a main magnet located at a central position and auxiliary magnets that are spaced apart from each other at a peripheral side of the main magnet and spaced apart from the main magnet to form the magnetic gap, and the magnetic circuit unit further comprises a main pole plate fixed to a surface of the main magnet facing the diaphragm and auxiliary pole plates fixed to surfaces of the auxiliary magnets facing the diaphragm.

9. The speaker as described in claim 1, wherein the dome is fixed to a surface of the inner edge away from the voice coil.

* * * * *